US006856080B2

(12) United States Patent
Shiffler, Jr. et al.

(10) Patent No.: US 6,856,080 B2
(45) Date of Patent: Feb. 15, 2005

(54) CARBONIZED RESIN COATED ANODE

(75) Inventors: Donald A. Shiffler, Jr., Albuquerque, NM (US); Michael D. Haworth, Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/682,388

(22) Filed: Aug. 28, 2001

(65) Prior Publication Data

US 2003/0042836 A1 Mar. 6, 2003

(51) Int. Cl.[7] ..... H01J 1/38

(52) U.S. Cl. ..... 313/355; 313/311; 313/348; 313/478; 313/479; 428/407; 428/408; 445/6; 445/58

(58) Field of Search ..... 313/355, 311, 313/478, 479, 348; 428/407, 408; 445/58, 6

(56) References Cited

U.S. PATENT DOCUMENTS 2,891,879 A 6/1959 Rohrer
3,462,289 A * 8/1969 Rohl et al. ..... 264/29.5
4,034,031 A 7/1977 Lersmacher et al.
4,137,477 A 1/1979 Krol et al.
4,241,104 A * 12/1980 Torbet ..... 156/283
4,263,268 A * 4/1981 Knox et al. ..... 264/29.1
4,392,238 A * 7/1983 Lersmacher et al. ..... 378/144
4,442,165 A * 4/1984 Gebhardt et al. ..... 428/307.7
4,609,972 A * 9/1986 Edeling et al. ..... 361/502
4,901,338 A * 2/1990 Rodhammer et al. ..... 378/144
5,025,490 A * 6/1991 Tamura ..... 313/478
5,656,885 A * 8/1997 Kohno et al. ..... 313/422
5,876,658 A * 3/1999 Takeda ..... 204/192.17
5,965,297 A * 10/1999 Fanteux et al. ..... 423/445 R
5,993,996 A * 11/1999 Firsich ..... 429/231.8

FOREIGN PATENT DOCUMENTS

DE 1667650 B * 10/1973 ..... C01B/31/04
DE 42 30 047 10/1993

* cited by examiner

*Primary Examiner*—Nimeshkumar D. Patel
*Assistant Examiner*—Sikha Roy
(74) *Attorney, Agent, or Firm*—James M. Skorich; Kenneth E. Callahan

(57) ABSTRACT

A vacuum tube having its anode/collector coated with carbonized resin plus pyrocarbon material to reduce outgassing and secondary electron emission and the method of coating the anode/collector.

6 Claims, 2 Drawing Sheets

Coated Anode at 425 kV

Un-Coated Anode at 425 kV

Coated Anode at 425 kV

CARBONIZED RESIN COATED ANODE

FEDERAL RESEARCH STATEMENT

The conditions under which this invention was made are such as to entitle the Government of the United States under paragraph l(a) of Executive Order 10096, as represented by the Secretary of the Air Force, to the entire right, title and interest therein, including foreign rights.

BACKGROUND OF INVENTION

The invention is in the field of vacuum tubes, and more particularly relates to a coated anode/collector designed to reduce out-gassing, plasma formation, and secondary electron production.

Every vacuum electronics device, ranging from radio frequency tubes to microwaves tubes, must have some region in which the cathode emitted electrons impact after participating in the desired interactions. Generally these anode/collector structures consist of stainless steel, oxygen free high conductivity (OFHC) copper or some other metal. Occasionally the metal is coated with an insulating material such as titanium nitride. Metals are generally the optimum structures due to the good electrical and thermal conductivity as well as the superior vacuum performance.

One major drawback with these materials is the production of secondary electrons, plasmas, and neutral gasses upon electron impact. Neutral gasses contribute to raising the pressure in the tube, reducing the vacuum. Plasmas not only increase the pressure but also cause the tube to short electrically, limiting the duration of microwave or radio frequency output. Plasmas can also cause damage to other components, e.g., the cathode or other metallic structures. Secondary electrons are electrons produced by the impact of the primary electron beam. A single primary electron can produce several or as many as hundreds of secondary electrons. These secondary electrons then cause the formation of plasmas and result in further out-gassing from the metal anode or collector.

These problems are amplified when the collector is biased to allow energy recovery from the primary electron beam. Here, the secondary electrons can easily be re-accelerated back into the collector, causing a cascading process producing more secondary electrons.

Accordingly, there is a need for an anode/collector that can significantly reduce the production of secondary electrons, plasma formation, and out-gassing of neutral gases.

SUMMARY OF INVENTION

In a preferred embodiment, the anode/collector surface of a vacuum tube is coated with a carbonized resin. A method of coating an anode/collector is described in which the anode/collector is coated with a thin film of carbon followed by a coating of a carbonizable resin. The anode/collector is then baked sufficiently to totally carbonize the resin followed by the deposition of pyrocarbon on the carbonized resin by chemical vapor deposition.

Other aspects and advantages of the present invention will become apparent from the following detailed description, taken in conjunction with the accompanying drawing, illustrating by way of example the principles of the invention.

DETAILED DESCRIPTION

Conventional vacuum tube anodes/collectors produce secondary electrons from the impact of electrons from the cathode, along with plasmas and neutral gasses that degrade the performance of the tube. The carbonized resin anode/collector coating of the present invention significantly reduces these problems. The coating can readily be applied to any anode shape or configuration.

Figure 1:
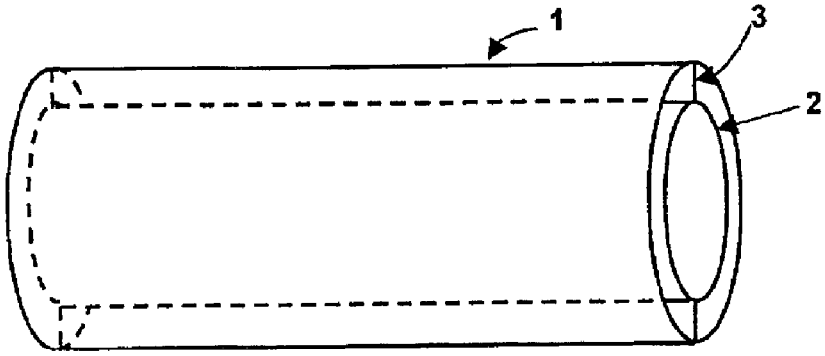
FIG. 1 illustrates a typical cylindrical anode/cathode configuration.
Figure 2:
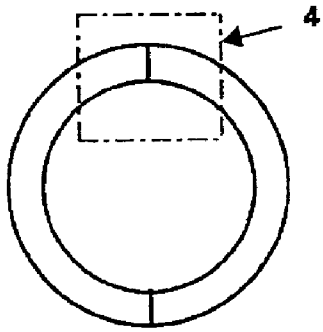
FIG. 2 is an end view of the cylindrical anode/cathode of FIG. 1

As an example, an anode structure having a cylindrical geometry is depicted in FIG. 1 with an end view shown in FIG. 2. A cathode 2 emits electrons that are accelerated to high energy towards the anode/collector 1. The cylindrical cathode is held in position within the cylindrical anode by a support 3. Electrons impact the anode at very high energy, leading to the production of neutral gas, plasma, and secondary electrons.

To reduce these deleterious effects, the anode/collector is coated using a carbon pyrolysis technique. First, a carbon surface or metal surface coated with a thin film of carbon is obtained in the shape of the desired anode. The electron impact surface is then coated with a carbonized resin. A carbonized resin, e.g., phenolic, is any resin that when heated sufficiently leaves only carbon in a solid state, generally in the form of a powder. The resin can be applied by painting, spraying, or dipping the part in a resin bath. The part is then baked to greater than 700° centigrade in a non-oxidizing atmosphere, decomposing the resin and releasing its volatile components. A porous carbon "char" residue is left on the surface.

Next, chemical vapor deposition (CVD) is used to infiltrate carbon into the porous char, creating a non-porous, rigid surface. This pyrocarbon material coating consists of a layer of carbon derived using pyrolysis through chemical vapor deposition (CVD). Pyrolysis through CVD is a process in which a low pressure hydrocarbon gas, methane for example, flows onto the part to be coated, is thermally decomposed, and deposits carbon on the part while releasing hydrogen. In particular, the carbonized part is heated to over 1000° centigrade while a low-pressure hydrocarbon gas is flowed onto it. The gas thermally decomposes, depositing carbon layers and releasing hydrogen. The length of the process depends on the size of the part to be coated, the number of layers required, and the gas flow rate. The thickness of the CVD film added depends on the degree of reduction required which in turn depends on the exact parameters of the device to be used. Films of up to millimeter thickness can be applied. The entire assembly is then placed in a vacuum bakeout at over 100° centigrade to remove any remaining water. The coating retains sufficient conductivity to conduct the incident electrons to the remainder of the pulsed circuit.

Figure 4:
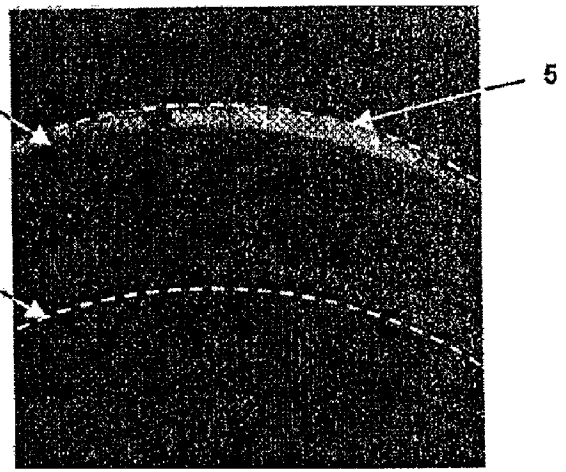
FIG. 4 is a low gain end view of a portion of the cylindrical anode/cathode at 425 kV with an uncoated anode.
Figure 3:
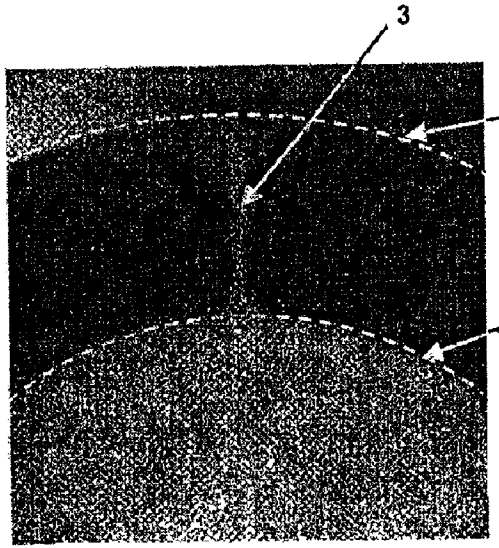
FIG. 3 is an end view of a portion of the cylindrical anode/cathode at 425 kV with the anode coated.

FIG. 3 is a scanned photograph of a portion of the cylindrical anode/cathode (see FIG. 2 dashed line 4) where the anode 1 has been coated with pyrocarbon material. The potential difference between the cathode and the anode is 425 kV. No plasma formation can be seen. For comparison, the same cylindrical anode/cathode at 425 kV is shown in FIG. 4 but with an uncoated anode. This low-gain photo clearly shows the plasma formation 5. The plasma brightness in FIG. 4 necessitated the much-reduced gain of FIG. 4 relative to FIG. 3.

The carbonized resin coating has several advantages over previous metals and coatings. This coating can be used in high and low vacuum. The coating can be applied in a complex range of shapes. Secondary electron production, neutral gas (out-gassing) production, and plasma production are greatly reduced, permitting microwave and radio frequency vacuum electronics to be run with higher efficiency due to lower pumping requirements. Many devices have been limited in peak power and pulse duration by these effects. These coated anodes have applications ranging from cathode ray tubes in computers, televisions, and displays to microwave tubes in radar, communications, and cooking. In addition, depressed collectors for energy recovery in microwave and rf tubes can be made more effective by using the coating to reduce the effects above.

What is claimed is:

1. A method of coating an electron impact surface of an anode with pyrocarbon, comprising:

coating the electron impact surface with a carbonizable resin;

carbonizing the resin to form a char;

directing a flow of hydrocarbon gas over the electron impact surface after heating the electron impact surface to at least 1000° C., to form a coating of pyrocarbon on the char; and removing any residual water from the pyrocarbon coating.

2. A coating method as recited in claim 1 wherein the removing water step includes heating the anode to at least 100° C. in a vacuum.

3. A coating method as recited in claim 1 wherein:

the carbonizable resin has volatile components; and carbonizing the resin includes heating the anode to a temperature sufficient to decompose the resin and release the volatile components, whereby the char is left as a porous residue.

4. A coating method as recited in claim 1 wherein the carbonizing step includes heating the anode to a temperature of at least 7000° C. in a non-oxidizing atmosphere.

5. A coating method as recited in claim 4 wherein the carbonizable resin is a phenolic.

6. A coating method as recited in claim 3 wherein the heating step includes baking the anode in an oven providing a non-oxidizing atmosphere.

* * * * *